US006120878A

United States Patent [19]

Follensbee et al.

[11] Patent Number: 6,120,878

[45] Date of Patent: Sep. 19, 2000

[54] ABRASIVE ARTICLES COMPRISING VINYL ETHER FUNCTIONAL RESINS

[75] Inventors: Robert A. Follensbee, Cottage Grove; Eric G. Larson, Lake Elmo, both of Minn.

[73] Assignee: 3M Innovative Properties Company, St. Paul, Minn.

[21] Appl. No.: 08/095,306

[22] Filed: Jul. 21, 1993

[51] Int. Cl.[7] ..... D06N 7/04

[52] U.S. Cl. ..... 428/150; 428/148; 51/298; 51/300; 51/303; 51/308; 51/309

[58] Field of Search ..... 428/147, 150; 51/298, 300, 303, 308, 309

[56] References Cited

U.S. PATENT DOCUMENTS

| | | | |
|---|---|---|---|
| 3,565,906 | 2/1971 | Jezic | 260/295 |
| 3,619,150 | 11/1971 | Rinker et al. | 51/295 |
| 3,712,920 | 1/1973 | Jezic | 260/332.5 |
| 3,759,989 | 9/1973 | Jezic | 260/539 A |
| 3,763,187 | 10/1973 | Moyle | 260/332.3 R |
| 4,011,358 | 3/1977 | Roelofs | 428/287 |
| 4,256,828 | 3/1981 | Smith | 430/280 |
| 4,652,274 | 3/1987 | Boettcher et al. | 51/298 |
| 4,740,577 | 4/1988 | DeVoe et al. | 528/51 |
| 4,836,832 | 6/1989 | Tumey et al. | 51/293 |
| 4,903,440 | 2/1990 | Larson et al. | 51/298 |
| 4,985,340 | 1/1991 | Palazzotto | 430/270 |
| 4,997,717 | 3/1991 | Rembold et al. | 478/413 |
| 5,059,701 | 10/1991 | Keipert | 556/13 |
| 5,178,636 | 1/1993 | Silberman | 623/6 |
| 5,191,101 | 3/1993 | Palazzoto et al. | 556/47 |

FOREIGN PATENT DOCUMENTS

| | | | |
|---|---|---|---|
| 0 109 581 A2 | 5/1984 | European Pat. Off. | C06F 15/20 |

*Primary Examiner*—Helen L. Pezzuto
*Attorney, Agent, or Firm*—Carolyn V. Peters

[57] ABSTRACT

Abrasive articles are provided having at least one of a backing material saturated with a saturant, a barrier coat, a make coat, a size coat layer or combinations thereof wherein the saturant and layers consisting essentially of 100% solids radiation-cured resin of one or more vinyl ether monomers and/or oligomers.

20 Claims, No Drawings

ABRASIVE ARTICLES COMPRISING VINYL ETHER FUNCTIONAL RESINS

TECHNICAL FIELD

This invention relates to abrasive articles wherein the backing treatment, barrier coat or make coats consist essentially of radiation-curable vinyl ether functional resins.

BACKGROUND OF THE INVENTION

Presently, abrasive articles can be used for wet grinding applications, such as automotive painted surfaces. In these applications, the paper backing material is treated to render the material water resistant. Such treatments include impregnation of the backing material with latex saturants, or backsizing the material with a water resistant coating. After the paper backing is saturated, several additional treatment steps are then employed to give the backing proper handling properties, resulting in a high production cost.

A disadvantage of present technology is the current paper backing material has an inherently rough surface. The roughness of the paper backing material can be greater than the particle size of a fine grade abrasive grain and can result in not all of the abrasive grains being in a single plane, therefore not allowing all of the abrasive grains to contact the workpiece during use. Therefore, with such a surface, it is difficult to produce a fine grade abrasive article having a thin, uniform mineral profile.

The cationic cure of epoxy resins as abrasive binders has been described in U.S. Pat. No. 4,997,717 and requires a thermal cure at 50 to 200° C. for one to ten minutes after initial irradiation with actinic light. This process requires an ionic salt of an organometallic complex cation as a photoinitiator.

U.S. Pat. No. 4,985,340 describes a polymeric precursor that can be employed as a binder for abrasive articles. The polymeric precursor is selected from the group consisting of (1) at least one ethylenically unsaturated monomer, optionally, in combination with a vinyl ether monomer and a curing agent comprising an organometallic salt and an onium salt.

U.S. Pat. No. 5,191,101 discloses energy polymerizable systems comprising a cationically polymerizable material and a catalytically effective amount of an ionic salt of an organometallic complex cation as polymerization initiator.

SUMMARY OF THE INVENTION

In one aspect of the present invention, an abrasive article is provided comprising in sequential order: a backing material treated with a water resistant 100% solids radiation-cured resin of one or more vinyl ether monomers and/or oligomers, a make coat, a plurality of abrasive grains, and a size coat.

It is particularly advantageous to treat or saturate a paper backing material with resins of one or more vinyl ether monomers and/or oligomers. The vinyl ether resins adhere well to paper fibers and provide (upon curing), a backing material with good flexibility, water resistance, and compatibility with a variety of make coat resins. Such compatibility provides an interface that resists delamination.

Furthermore, using vinyl ether resins are more economical than the present technology of using latex saturation for paper backings. When compared to acrylates, vinyl ether resins are less odorous, have less toxicity and are not oxygen inhibited (eliminating the need to cure in an inert atmosphere). When compared to cationically cured epoxies, the vinyl ethers cure faster, provide paper backing materials with better water resistance and less embrittlement.

In another aspect of the present invention, an abrasive article is provided comprising: a waterproof backing material, a barrier coat layer of 100% solids radiation curable resin of one or more vinyl ether monomers and/or oligomers, a make coat, a plurality of abrasive grains and a size coat.

Advantageously, the barrier layer of cured vinyl ether resin provides a smooth surface and facilitates application of fine abrasive grains. Furthermore, the layer provides a water barrier when the abrasive article is used in wet grinding applications.

In yet another aspect of the present invention, a make coat layer or a size coat layer can consist essentially of 100% solids radiation curable resins of one or more vinyl ether monomers and/or oligomers. The make coat and size coat layer compositions can further include additives including fillers, grinding aids, fibers, anitstatic agents, lubricants, wetting agents, surfactants, pigments, dyes, coupling agents, plasticizers and suspending agents. The amount of these additions are selected to provide conventionally known properties. However, the inclusion of these additives do not materially affect the basic and novel characteristics of the present invention.

Advantageously, several benefits are attainable when utilizing vinyl ether resins as a make and/or size coat layer, such as an improved cut (make coat) or leave a smoother surface finish (size coat), depending upon the particular application.

As used in this application:

"monomers and/or oligomers" means the curable liquid resins that may be monomers, oligomers, and blends thereof, "treated" means the paper backing material has sorbed curable vinyl ether resin and been exposed to a radiation source to cure the resin, and "vinyl ether resin" means a 100% solids radiation curable vinyl ether resin of one or more vinyl ether monomers and/or oligomers.

DESCRIPTION OF THE PREFERRED EMBODIMENT(S)

The present invention provides a flexible, water resistant abrasive article by providing 100% solids radiation-curable vinyl ether resins that cure rapidly by exposure to a radiation source. The vinyl ether resin may be applied as a paper saturant to produce a waterproof backing that is more cost effective than the present technology while using a less complex fabrication process. Alternatively, the vinyl ether resins may be applied as a thin layer to a previously saturated or waterproof abrasive paper backing material. The slow penetration of the resin into the paper backing material results in a make coat side surface with improved smoothness and good handling properties.

In one embodiment of the present invention the abrasive article is comprised of a paper backing material treated with a water resistant 100% solids radiation-cured resin of one or more vinyl ether monomers and/or oligomers, a make coat, a plurality of abrasive grains, and a size coat.

An alternative embodiment of the present invention is an abrasive article wherein the backing material is either presaturated or otherwise made waterproof coated with a thin layer of a cured vinyl ether resin.

In yet another alternative embodiment, the abrasive article of the present invention may be made using a make and/or size coat layer consisting essentially of 100% solids radiation curable resins of one or more vinyl ether monomers and/or oligomers.

Other nonlimiting examples of configurations contemplated may include an abrasive article having:

(1) a backing material saturated with a vinyl ether resin, and a barrier coat of a vinyl ether resin;

(2) a backing material saturated with a vinyl ether resin and a make coat layer of a vinyl ether resin;

(3) a backing material saturated with a vinyl ether resin and a size coat layer of a vinyl ether resin;

(4) a backing material saturated with a vinyl ether resin, barrier coat, make coat and size coat layers of a vinyl ether resin; and (5) make coat and size coat layers of a vinyl ether resin.

Furthermore, when more than one element of the abrasive article consists essentially of a vinyl ether resin, the resins used may be the same or different vinyl ether resins.

Useful paper backing materials are porous papers with enough porosity to imbibe the vinyl ether resin saturant to at least 10% saturation and nonlimiting examples can include a bleached 78 g/m$^2$ grade paper (A weight) with a urea formaldehyde wet strength additive produced by a chemical pulping process by Mosinee Paper Co. (#2406-A) or a non-bleached 107 g/m$^2$ grade paper (C weight) produced by a chemical pulping process by Mosinee Paper Co. (#1842-B MF 2062-SP)

When a vinyl ether resin is used as a barrier coat, make coat or size coat layer, the backing material can include paper, a polymeric film, cloth, a fibre web such as a vulcanized cotton fibre web, a nonwoven web, combinations or composites thereof or treated versions of these.

Useful waterproof backing materials include any of the above stated substrates that have been treated with any waterproofing treatments, such as those papers available from Kammerer GmbH and known to those skilled in the art.

The paper backing material is either saturated with a vinyl ether resin or a thin layer of vinyl ether resin is coated (also referred to as a "barrier coat") onto a presaturated or waterproof backing material. The vinyl ether resin is 100% solids and is radiation curable. The curable resin compositions comprise vinyl ethers, and a cationic curing agent. When the vinyl ether resin is used as a barrier coat, the dry coating weights are typically in the range of 5 to 25 g/m$^2$. When the vinyl ether resin is used to saturated a backing material, the range of paper saturant pick-up weight is 10–60%. If the pick-up is significantly less than 10%, the paper will not be sufficiently waterproofed. At saturant pick-up weights of significantly greater than 60%, the cost effectiveness diminishes. Percent saturant pick-up on paper can be derived using the following equation:

$$\% S_{PU} = \frac{(P_D) - (P_{BW})}{P_{BW}} \times 100$$

wherein:

% $S_{PU}$ is the % saturant pick-up of a backing material, $P_D$ is the weight of dry saturated backing material, $P_{BW}$ is the basis weight of the backing material. Basis weight is the dry weight of a paper backing material per unit area.

Vinyl ethers readily undergo cationic polymerization. Typical cationic curing agents are salts of organometallic complex cations, such as described in European Patent Application 109,581, U.S. Pat. No. 4,740,577, and U.S. Pat. No. 5,059,701 and include, for example, commercially available Irgacure™ 261 (Ciba Geigy). Another example of a curing agent is a mixture of a salt of an organometallic complex cation and an onium salt as described above in U.S. Pat. No. 4,985,340. Useful onium salts include aromatic iodonium cations described in U.S. Pat. Nos. 3,565,906, 3,712,920, 3,759,989 and 3,763,187; and 4,256,828 and aromatic sulfonium salts and in particular triaryl-substituted sulfonium compounds, for example those described in U.S. Pat. No. 4,256,828. The preferred radiation activated curing system is a mixture of Irgacure™ 261 and triarylsulfonium salts (commercially available from 3M and Union Carbide).

Vinyl ethers that may be used in the present invention include vinyl alkyl ethers, such as, vinyl methyl ether, vinyl ethyl ether, vinyl n-butyl ether, vinyl 2-chloroethyl ether, vinyl isobutyl ether, and vinyl 2-ethylhexyl ether; vinyl aryl ethers, such as vinyl phenyl ether; and vinyl ethers of substituted aliphatic alcohols, such as, 1,3-di(ethenoxy) butane, vinyl 4-hydroxy-butyl ether. Preferred vinyl ethers include 1,4-cyclohexanedimethanol divinyl ether, divinyl ether of triethylene glycol, propenyl ether of propylene carbonate, a liquid aliphatic ester resin having divinyl ether functionality, 4-hydroxybutyl vinyl ether with tolylene diisocyanate, and divinyl ethers, and in particular, divinyl ethers of polyethers or polyester diols and divinyl ethers of urethanes or diisocyanates.

The vinyl ether resins when used as a coating layer can be applied to a backing material using coating techniques known to those skilled in the art and include dip coating, roll coating, knife coating and the like.

To cure the coating layer(s) after coating, the layer(s) are exposed to a radiation energy source for a period of time and with intensity dependent on the thickness of the coating, size of the abrasive grains, and type and amount of optional additive. Such curing conditions, including duration, wavelength, and intensity are readily ascertainable by those skilled in the art. Energy sources include electron beam, ultraviolet or visible light.

The backing material can be coated with the first layer of adhesive, commonly referred to as a "make coat", and then the abrasive grains are applied. Typically, the resulting adhesive/abrasive combination or composite is partially cured to adhere the abrasive grains to the backing material, so that a second layer of adhesive (size coat) can be applied. Generally, the size coat further reinforces the coated abrasive product. Once the size coat is cured or solidified, the resulting coated abrasive product can be converted into a variety of convenient forms for various uses, for example sheets, rolls, belts, and discs. Typically, the size coat and make coat are the same, although this is not necessary.

Examples of useful make and size coat compositions are known in the art and include two classes of thermosetting resins, condensation curable and addition polymerizable resins. The preferred coat composition precursors (also referred to as "precursors") are addition polymerizable resins because they are readily cured by exposure to radiation energy. Addition polymerizable resins can polymerize through a cationic mechanism or a free radical mechanism. Depending upon the energy source that is utilized and the precursor chemistry, a curing agent, initiator, or catalyst is sometimes preferred to help initiate the polymerization. The dry coating weights of the make and size coats can vary depending on the size of the abrasive grains used and typically range from 4 g/m$^2$ to 310 g/m$^2$ for make coats and 12 g/m$^2$ to 550 g/m$^2$ for size coats.

Nonlimiting examples of precursors can include phenolic resins (e.g., "Durez" from Occidental Chemical and "Aerofene" from Ashland Chemicals); urea-formaldehyde resins; melamine formaldehyde resins; acrylated urethanes (e.g., "Uvithane 782" from Morton Internaltional); ethylenically unsaturated compounds (e.g., methyl acrylate, ethyl acrylate); aminoplast derivatives having pendant unsaturated carbonyl groups (e.g., those described in U.S. Pat. No. 4,903,440); isocyanurate derivatives having at least one pendant acrylate group and isocyanate derivatives having at least one pendant acrylate group (e.g., those described in U.S. Pat. No. 4,652,274); epoxy resins (e.g., diglycidyl ether of bisphenol A); and mixtures and combinations thereof. The term "acrylate" encompasses acrylates and methacrylates.

It is within the scope of the present invention to have additional coating layers as dictated by the function or purpose of the coating layer as known to one skilled in the art. For example, even when the backing material is saturated with a vinyl ether resin, it may be desirable to provide a barrier coat to smooth the inherent textured surface of the paper backing material, particularly when utilizing fine grades of abrasive (grades 400 and finer). A backsize coat, which is applied to the back side of the backing material, that is, the side opposite to which the abrasive grains are applied, adds body to the backing material and protects the backing material from wear. A subsize coat is similar to a saturation coat except that it is applied to a previously treated backing. A supersize coat, that is, a coating layer applied over the size coat, can be added to provide a grinding aid, and/or as an antiloading coating, that is, to prohibit abrasive grain loading.

Commonly used abrasive grains include, flint, garnet, emery, silicon carbide, aluminum oxide, ceramic aluminum oxide, alumina zirconia or multi-grain granules. The abrasive grain particle sizes can range from 0.1 micrometer ($\mu$m) to 2000 $\mu$m (12 to 2500 grade), and typically between 1 to 500 $\mu$m and preferably between 1 to 100 $\mu$m. Coating weights for the abrasive grains are dependent upon the bonding systems used, the process for applying the grains and the size of the grains and typically range from 5.0 g/m$^2$ to 1,350 g/m$^2$.

The following non-limiting examples will further illustrate the invention. All ratios are based upon weight unless indicated otherwise. The following material designations will be used.

| Glossary | |
|---|---|
| A-1100 | an amino silane coupling agent (commercially available under the trade designation "A-1100" from Union Carbide) |
| CHVE | 1,4-cyclohexanedimethanol divinyl ether (commercially available from International Specialty Products under the trade designation "RAPI-CURE CHVE") |
| D230 | an amine-terminated polypropylene glycol (commercially available under the trade designation "Jeffamine D-230" from Texaco Chemical Co.) |
| DVE-3 | divinyl ether of triethylene glycol (commercially available from International Specialty Products under the trade designation "RAPI-CURE DVE-3") |
| EDR-148 | an amine-terminated polyethylene glycol (commercially available under the trade designation "Jeffamine EDR-148" from Texaco Chemical Co.) |
| EM-1 | the diglycidyl ether of bisphenol A (commercially available from Shell Chemical Co., under the trade designation "EPON 828") |
| HBVE | 1,4-hydroxybutyl vinyl ether (commercially available from International Specialty Products under the trade designation "RAPI-CURE HBVE") |

-continued

| Glossary | |
|---|---|
| IW-33 | a nonionic surfactant available under the trade designation "INTERWET 33" from Interstab Chemicals of New Brunswick, New Jersey |
| MEK | methyl ethyl ketone |
| P5018 | an aliphatic tetrafunctional polyester acrylate oligomer (commercially available from Henkel Corporation under the trade designation "Photomer 5018") |
| Paper 1 | a bleached 78 g/m$^2$ grade paper (A weight) with a urea formaldehyde wet strength additive produced by a chemical pulping process by Mosinee Paper Co. (#2406-A) |
| Paper 2 | a non-bleached 107 g/m$^2$ grade paper (C weight) produced by a chemical pulping process by Mosinee Paper Co. (#1842-B MF 2062-SP) |
| PEPC | propenyl ether of propylene carbonate (commercially available from International Specialty Products under the trade designation "RAPI-CURE PEPC") |
| PH-1 | a resole phenolic resin having 70% solids |
| RD-1 | butyl glycidyl ether (commercially available from Ciba under the trade designation "Araldite RD-1") |
| RD-2 | butanediol diglycidyl ether (commercially available from Ciba under the trade designation "Araldite RD-2") |
| SL-7604 | a surfactant available under the trade designation "SILWET L-7604" from Union Carbide of Danbury, CT |
| UVI-6990 | a triaryl sulfonium salt photocatalyst (commercially available from Union Carbide under the trade designation "Cyracure UVI-6990" |
| V2010 | a liquid aromatic urethane resin having divinylether functionality (commercially available from Allied-Signal, Inc. under the trade designation "VECTOMER 2010") |
| V2020 | a liquid aliphatic urethane resin having divinyl ether functionality (commercially available from Allied-Signal, Inc. under the trade designation "VECTOMER 2020") |
| V4010 | a liquid aromatic ester resin having divinylether functionality (commercially available from Allied-Signal, Inc. under the trade designation "VECTOMER 4010") |
| V4030 | a liquid aliphatic ester resin having divinylether functionality (commercially available from Allied-Signal, Inc. under the trade designation "VECTOMER 4030") |

TEST PROCEDURES

Tensile Test

The coated abrasive paper backing example was converted into a 2.5 cm by 17.8 cm strip. The strip was installed on a Sintech machine and tested for tensile strength. The tensile values were for the amount of force required to break the strip. The machine direction (MD) strips were taken from the machine direction or the vertical direction of the paper backing. The cross direction (CD) strips were taken in the cross direction or the horizontal direction of the paper backing. In each case these tests were performed in accordance with ASTM D1682, method 2C-T.

Wet Schiefer Test

This test provided a measure of the cut (material removed from a workpiece) and finish (the relative quality of the abraded surface) of coated abrasive articles under wet conditions. A 10.2 cm diameter circular specimen was cut from the abrasive material tested and secured by a pressure-sensitive adhesive to a back-up pad that had been preconditioned by soaking in water. The abrasive material was then pre-wetted by floating in water. The back-up pad was secured to the driven plate of a Schiefer Abrasion Tester (available from Frazier Precision Company) that had been plumbed for wet testing. A circular acrylic plastic workpiece, 10.2 cm diameter by 1.3 cm thick, available under the trade designation "POLYCAST" acrylic plastic from Seelye Plastics, Bloomington, Minn. was employed.

The initial weight of each workpiece was recorded to the nearest milligram prior to mounting on the workpiece holder of the abrasion tester. The water drip rate was set to 60 (+/−6) grams per minute. A 4.5 kg load was placed on the abrasion tester weight platform and the mounted abrasive specimen was lowered onto the workpiece. The machine was set to run for 500 cycles and then automatically stop. After each 500 cycles of the test, the workpiece was wiped free of water and debris and weighed. The cumulative cut for each 500-cycle test was the difference between the initial weight and the weight following each test. The endpoint of the test was 2,500 revolutions or cycles of the coated abrasive disc.

If the finish of the workpiece was determined, the abraded workpiece was mounted in the specimen holder of a "Rank Surtronic 3" profilometer, available from Rank Taylor-Hobson, Leicester, England, and the surface profile measured. Rtm, which is the mean of the maximum peak-to-valley values from each of 5 sampling lengths, was recorded for each test. Ra is the arithmetic average of the scratch size in microinches.

Knoop Hardness Indentation Test

This indentation hardness determination of organic/polymeric coatings is described in ASTM D 1474-85 (Method A). Coatings of approximately 0.38 mm were applied to a rigid surface, preferably glass microscope slides. Subsequently, the coatings were dried and/or cured by an energy source. The method consisted of applying a 100 gram load to the surface of the coating by means of a pyramidal shaped diamond having specific face angles and converting the length measurement of the resulting permanent indentation to the Knoop Hardness Numbers (KHN). A Tukon Hardness Tester Model 200 was used for the measurements and is available from Wilson Instruments. For saturants, the KHN can be less than 10. Acceptable KHN values for make coats are 7–14 and size coats are at least 15.

Crumple Test

A 10 cm×15 cm abrasive sample was soaked for one hour in water. The article is crumpled into a tight ball with the face-side in (that is, the abrasive grain side in). The article was then flattened out and inspected for the following defects:

(1) face cracks—cracks in the abrasive bond between the make coat and the backing material and possible loss of mineral along folds;

(2) delamination—abrasive grains strips or chips off the paper backing material; and (3) paper failure—tears, cracks or holes in the paper backing material.

Reaction of HBVE with Tolylene Diisocyanate

A one liter, three neck round bottom flask, dry air inlet, mechanical stirrer, and addition funnel were all oven dried and assembled under nitrogen. Then, the flask was charged with 232.3 grams (2.0 moles) of HBVE. The addition funnel was charged with 174.2 grams (1.0 mole) tolylene diisocyanate (80% 2,4 isomer and 20% 2,6 isomer from Aldrich Chemical), which was added dropwise to the stirred flask contents which was warmed in a 65° C. oil bath during the slow addition process. This addition required two hours. After addition was complete, the oil bath temperature was raised to 75° C. for one hour, and an infrared spectrum of the sample taken prior to this hour at 75° C., showed very little isocyanate absorbance. The warm product was poured into a pint jar and labeled TDI-VE.

Reaction of HBVE with Isophorone Diisocyanate

An oven dried one liter three neck flask equipped with a drying tube, mechanical stirrer, and addition funnel was charged with 232.3 grams (2.0 moles) HBVE and 1.0 g. dibutyltin dilaurate catalyst. The addition funnel was charged with isophorone diisocyanate (222.3 grams, 1.0 mole, Aldrich Chemical Co.) which was added dropwise to the reaction mixture which was warmed to 70° C. via an oil bath. Complete addition required longer than 90 minutes and the 70° C. conditions with stirring were continued for an additional two hours. Infrared spectra showed that the isocyanate absorption was absent. The warm product was poured into a pint jar and labeled IP-VE.

PAPER SATURANT (PS) PREPARATION

COMPARATIVE EXAMPLE CPSA AND EXAMPLES PSB-PSD

The vinyl ether oligomer was first heated to 100° C. and weighed into a glass jar. To this, the monomer was added and mixed in thoroughly. This mixture was heated for approximately 15 minutes at 100° C. After cooling to about 60–70° C., the photoinitiator was added and mixed into the resin.

The papers described in these examples were saturated by roll coating utilizing a stainless steel top roll and a hard rubber bottom roll. Uniform saturation was achieved with a coater speed of 6.1 m/min. and a nip pressure of 250 kPa. Thorough curing of the saturated paper backings was accomplished by exposing each side to eight passes beneath a 120 watt/cm Fusion Systems UV lamp at 19.0 m./min. An additional thermal cure of thirty minutes at 120° C. ensured complete cure.

Table 1 summarizes the resin formulations (CPSA and PSB-PSD) utilized for the paper saturation examples. Different vinyl ether chemistries (both oligomer and monomer reactive diluents) were investigated to impart different final properties to the saturated papers. PSB and PSD contained vinyl ether components that remained relatively soft and flexible when completely cured. PSC contained rapidly curing vinyl ether components that formed a harder, stiffer cross-linked matrix. PSA was a comparative epoxy-only formulation.

Measuring dry and wet tensile strength was used to determine the efficacy of these paper saturants. Table 2 summarizes machine and cross direction results for two different papers saturated separately with the four resins summarized in Table 1. When fully cured with UV and thermal energy, the epoxy saturant (CPSA) gave some good dry and wet tensile strengths when incorporated into paper 1. However, this paper was too brittle, because it tended to shatter catastrophically at very low percent stretches (see column 5 of Table 2). This resin also demonstrated inferior behavior when it was impregnated into a more poorly bonded paper (Paper 2) having a wet tensile load of 3.1 kg whenmeasured in the machine direction. The vinyl ether resins, PSB and PSC provided excellent tensile strength without the brittleness for a variety of paper backings. The machine direction wet tensile strength of PSC was equivalent to that of the epoxy formulation (CPSA) (13.9 kg vs. 14.2 kg) using paper 1, but was clearly superior in paper 2 (6.5 kg vs. 3.1 kg). In addition, the percent stretches of the vinyl ether resin saturated papers were significantly higher, especially in the cross direction.

A further demonstration of the advantages of using vinyl ether resin saturants was its performance in the wet crumple test. When the vinyl ether saturants (PSB-PSD) were evaluated, the abrasive papers had acceptable flexibilities. The CPSA saturated abrasive paper failed the crumple test because of brittleness.

TABLE 1

Paper Saturant Resin Formulations

| Component | CPSA (comparative) | PSB | PSC | PSD |
|---|---|---|---|---|
| CHVE | — | — | 11.3 | — |
| DVE-3 | — | 45.0 | 6.5 | — |
| EM-1 | 71.0 | — | — | — |
| HBVE | — | — | — | 50.0 |
| P5018 | — | — | — | 50.0 |
| RD-1 | 29.0 | — | — | — |
| TDI-VE | — | — | 52.4 | — |
| UVI-6990 | 1.5 | 1.5 | 1.5 | 2.0 |
| V2020 | — | 30.0 | — | — |
| V4030 | — | 25.0 | 28.3 | — |

TABLE 2

Tensile Data for Saturated Papers

| Paper | Resin | Peak Load (kg.) Dry | Peak Load (kg.) Wet | % Stretch @ Break |
|---|---|---|---|---|
| Machine Direction | | | | |
| 1 | CPSA | 30.5 | 14.2 | 2.3 |
| 1 | PSB | 24.7 | 10.1 | 2.9 |
| 1 | PSC | 26.1 | 13.9 | 2.7 |
| 1 | PSD | 18.4 | 4.4 | 2.4 |
| 2 | CPSA | 28.3 | 3.1 | 2.5 |
| 2 | PSC | 31.2 | 6.5 | 3.2 |
| Cross Direction | | | | |
| 1 | CPSA | 14.0 | 5.7 | 2.7 |
| 1 | PSB | 9.6 | 3.5 | 4.5 |
| 1 | PSC | 11.7 | 4.9 | 3.9 |
| 1 | PSD | 6.3 | 1.5 | 4.7 |
| 2 | CPSA | 10.1 | 1.4 | 4.6 |
| 2 | PSC | 11.6 | 2.2 | 5.4 |

General Procedure 1 For Preparing Coated Abrasives

Make resins were applied at a coating weight of 3.7 g/m$^2$ to ethylene acrylic acid primed, 76 $\mu$m (3.0 mil) polyester film using a ten cm wide die coater over a rubber roll. The line speed was 4.6 m/min. Grade P320 aluminum oxide mineral was electrostatically applied into the wet make resin at a coating weight of 73 g/m$^2$. Immediately, the web was irradiated by one 120 watt/cm lamp; certain make resins required an additional thermal pre-cure of thirty minutes at 120° C. The size coat resin, applied by a roll coater at a line speed of 9.1 m/min. at a pressure of 172 kPa, produced a dry size coat weight of 38 g/m$^2$. Final cure was for 70 minutes at 120° C.

General Procedure 2 for Preparing Coated Abrasives

This procedure was identical to Procedure 1 except for the following size coating and curing conditions. The size resin was applied by a roll coater having a stainless steel top roll and a hard rubber lower roll. Coating at a pressure of 690 kPa at a speed of 0.5 m/min. produced a dry size weight of 30 g/m$^2$. The vinyl ether constructions were cured after twelve passes beneath a 120 watt/cm Fusion Systems D-bulb at a speed of 30.5 m/min. Cure of the epoxy construction required six passes beneath the 120 watt/cm Fusion Systems D-bulb at a speed of 30.5 m/min., 25 minutes at 115° C. and 25 minutes at 125° C.

COMPARATIVE EXAMPLES C1–C4 AND EXAMPLES 1–4

Make and Size Coat Examples

Another demonstration of the effectiveness of vinyl ether resins in coated abrasives was their utilization as a make and size coat layer in a P320 grade construction. A cationically cured epoxy make or size coat served as a comparative example. Table 3 summarizes the make coat formulations (formulations E, F and G) and the size coat formulations (H and I) used in the example constructions. Table 4 describes a phenolic/amine size coat formulation that was thermally cured.

Two commercially available grade P320 coated abrasives were utilized as a basis for expected product performance. Comparative Example C1 was a grade P320 255 Production Frecut Film commercially available form the Minnesota Mining and Manufacturing Company. The Frecut supersize was removed by solvent prior to the Schiefer testing. C2 was a grade P320 213Q Imperial Wetordry Production Paper A Weight also available from the Minnesota Mining and Manufacturing Company.

Table 5 summarizes Schiefer cut and finish data. Examples 1–2 and C3 were constructed with radiation curable make coats (resins E, F and G) and a heat curable phenolic size coat (resin J). All three examples had acceptable cut performances that fell between the cuts measured for C1 and C2. However, C3 required an additional thermal cure step (30 minutes at 120° C.) to achieve this acceptable performance. In addition, the surface finishes (Ra and Rtm) were significantly poorer for the epoxy example compared to the two vinyl ether make coats (Examples 1 and 2).

In examples 3–4 and C4, the make and size resins were cationic radiation curable formulations. While none of the cuts were as high as the commercially available products, the constructions left a much smoother finish on the abraded workpiece. In addition, the vinyl ether constructions (Examples 3 and 4) required no additional thermal processing. The epoxy construction (C4) had the poorest grinding performance and also suffered the disadvantage of long thermal processing times (25 minutes at 115° C. plus 25 minutes at 125° C.). There would be no advantage to use the cationically cured epoxies in both the make and size coat, since this abrasive article would require as much thermal processing as an all phenolic construction.

Table 6 summarizes the Knoop Hardness data obtained on the radiation curable resins described in Tables 1 and 3. These data may serve as a guideline for the hardness requirements of various cured resins in different parts of the coated abrasive constructions (for example, saturant, make coat, or size coat).

TABLE 3

Binder Resin Formulations

| Component | Resins E | F | G | H | I |
|---|---|---|---|---|---|
| CHVE | — | — | — | 28.8 | — |
| EM-1 | — | — | 71.0 | — | 37.4 |
| FS | — | — | — | 25.0 | — |

TABLE 3-continued

Binder Resin Formulations

| Component | Resins E | F | G | H | I |
|---|---|---|---|---|---|
| IP-VE | 25.0 | — | — | 23.6 | — |
| MEK | — | — | — | 11.4 | — |
| PEPC | — | — | — | 4.5 | — |
| RD-1 | — | — | 29.0 | — | 9.6 |
| RD-2 | — | — | — | — | 53.0 |
| UVI-6990 | 1.2 | 1.2 | 1.2 | 1.1 | 1.5 |
| V2010 | — | 12.5 | — | — | — |
| V2020 | — | 12.5 | — | — | — |
| V4010 | 75.0 | — | — | 6.7 | — |
| V4030 | — | 75.0 | — | — | — |

TABLE 4

Size Resin Formulation

| Component | J |
|---|---|
| A-1100 | 1.0 |
| D-230 | 24.0 |
| EDR-148 | 10.0 |
| IW-33 | 0.5 |
| PH-1 | 64.0 |
| SL-7604 | 0.5 |

TABLE 5

Schiefer Cut & Finish Data

| Example | Make Resin | Size Resin | Total Cut (grams) | Rtm | Ra |
|---|---|---|---|---|---|
| C1 | | | 9.08 | 183 | 30 |
| C2 | | | 7.62 | 167 | 27 |
| 1 | E | J | 8.86 | 171 | 26 |
| 2 | F | J | 8.13 | 149 | 24 |
| C3 | G | J | 8.92 | 183 | 29 |
| 3 | E | H | 5.09 | 129 | 20 |
| 4 | F | H | 2.86 | 101 | 15 |
| C4 | G | I | 2.74 | 96 | 15 |

TABLE 6

Knoop Hardness

| Resin | KHN (dry) | Use of Resin |
|---|---|---|
| A | <2 | Saturant |
| B | <1 | " |
| C | 10.0 | " |
| D | <2 | " |
| E | 9.8 | Make coat |
| F | 8.4 | " |
| G | <2 | " |
| H | 18.4 | Size coat |
| I | <2 | " |

EXAMPLE 5

Barrier Coat Example

This example demonstrates the utility of a barrier coat prepared from a vinyl ether resin.

A barrier coat composition was prepared having the formulation: 15% by weight PEPC, 35% by weight HBVE, 50% by weight V2020 and 2.5 % by weight UVI-6990. The make coat formulation was a blend of resole phenolic and diacrylate monomer as described in Table 20, col. 33, U.S. Pat. No. 5,178,636 and such description is incorporated herein by reference. The size coat formulation was Resin J of Table 4. The backing material was Abrasive Paper-Waterproof, Grey 010, 115 g/m$^2$, 719073 available from Kammerer GmbH.

The barrier coat was coated to a dry coating weight of 17.0 g/m$^2$, the make coat had a dry coating weight of 9.0 g/m$^2$ and the size coat has a dry coating weight of 7.5 g/m$^2$.

The barrier coat was applied to a 15×25 cm paper sample with a Meyer bar having grooves 0.025 mm deep. The cure was accomplished by passing the coating 8 times beneath a 120 Watt/cm Fusion Systems D bulb at a speed of 15.5 m/min. The make coat was also applied with the Meyer bar and partially cured with one pass beneath the UV bulb at a speed of 32.0 m/min. A grade 1200 silicon carbide mineral (Fujimi) was drop coated into the make coat and provided a mineral weight of approximately 24.0 g/m$^2$. The make coat was thermally cured by heating the coating for 30 minutes at 116° C. The size coat was roll coated according to the description found in General Procedure 2 for Preparing Coated Abrasives. The abrasive article was then cured for 70 minutes at 120° C.

TABLE 7

Schiefer Cut & Finish Data

| Barrier Coat | Cut, gms | Ra | Rtm |
|---|---|---|---|
| No | 2.162 | 5.0 | 31.2 |
| Yes | 2.986 | 5.6 | 36.6 |

The cut was significantly improved when a vinyl ether resin barrier layer was included in the abrasive article, although the finish was not particularly affected.

Various modifications and alterations of this invention will become apparent to those skilled in the art without departing from the scope and principles of this invention, and it should be understood that this invention is not to be unduly limited to the illustrative embodiments set forth hereinabove. All publications and patents are herein incorporated by reference to the same extent as if each individual publication or patent was specifically and individually indicated to be incorporated by reference.

What is claimed:

1. An abrasive article comprising in sequential order: a backing material treated with a saturant consisting essentially of a water resistant 100% solids radiation-cured resin of one or more vinyl ether monomers and/or oligomers, a make coat, a plurality of abrasive grains, and a size coat.

2. The abrasive article according to claim 1 wherein the backing material is a porous paper.

3. The abrasive article according to claim 1 wherein the backing material is saturated with the vinyl ether resin in the range of 10–60% wherein % saturation is determined using the equation:

$$\% S_{PU} = \frac{(P_D) - (P_{BW})}{P_{BW}} \times 100$$

wherein:

% $S_{PU}$ is the % saturant pick-up of a backing material, $P_D$ is the weight of dry saturated backing material, $P_{BW}$ is the basis weight of the backing material and basis weight is the dry weight of a paper backing material per unit area of the backing material.

4. The abrasive article according to claim 1 wherein the vinyl ether monomers and/or oligomers are divinyl ethers.

5. The abrasive article according to claim 4 wherein the divinyl ethers are either a divinyl ether of polyethers or polyester diols or a divinyl ether of urethanes or diisocyanates.

6. The abrasive article according to claim 1 further comprising a barrier coat layer.

7. The abrasive article according to claim 6 wherein the barrier coat, make coat, size coat layer or combinations thereof consist essentially of 100% solids radiation-cured resin of one or more vinyl ether monomers and/or oligomers.

8. The abrasive article according to claim 1 wherein the backing material is paper, and the vinyl ether resin is a reaction product of (a) 1,4-cyclohexanedimethanol divinyl ether, (b) divinyl ether of triethylene glycol, (c) a liquid aliphatic ester resin having divinyl ether functionality (d) reaction product of 1,4-hydroxybutyl vinyl ether with tolylene diisocyanate, and (e) a catalytically effective amount of a triaryl sulfonium salt photocatalyst that upon exposure to a radiation source will polymerize the cationically polymerizable components (a), (b), and (c).

9. An abrasive article comprising: a waterproof backing material, a barrier coat layer consisting essentially of 100% solids radiation curable resin of one or more vinyl ether monomers and/or oligomers, a make coat, a plurality of abrasive grains and a size coat.

10. The abrasive article according to claim 9 wherein the dry coating weights of the barrier coat layer are typically in the range of 5 to 25 $g/m^2$.

11. The abrasive article according to claim 9 wherein the vinyl ether resins are divinyl ethers.

12. The abrasive article according to claim 11 wherein the divinyl ethers are either a divinyl ether of polyether or polyester diols or a divinyl ether of urethanes or diisocyanate.

13. The abrasive article according to claim 9 wherein the make coat, size coat or both layers consist essentially of 100% solids radiation-cured resin of one or more vinyl ether monomers and/or oligomers.

14. An abrasive article comprising a backing material, a make coat consisting essentially of 100% solids radiation curable resin of one or more vinyl ether monomers and/or oligomers, a plurality of abrasive grains and a size coat.

15. The abrasive article according to claim 14 wherein the vinyl ether monomers and/or oligomers are divinyl ethers.

16. The abrasive article according to claim 14 wherein the divinyl ethers are either a divinyl ether of polyether or polyester diols or a divinyl ether of urethanes or diisocyanate.

17. An abrasive article comprising a backing material, a make coat, a plurality of abrasive grains and a size coat consisting essentially of 100% solids radiation curable resin of one or more vinyl ether monomers and/or oligomers.

18. The abrasive article according to claim 17 wherein the vinyl ether monomers and/or oligomers are divinyl ethers.

19. The abrasive article according to claim 18 wherein the divinyl ethers are either a divinyl ether of polyether or polyester diols or a divinyl ether of urethanes or diisocyanate.

20. The abrasive article according to claim 18 wherein the make coat consists essentially of 100% solids radiation-cured resin of one or more vinyl ether monomers and/or oligomers.

* * * * *

UNITED STATES PATENT AND TRADEMARK OFFICE

CERTIFICATE OF CORRECTION

PATENT NO. : 6,120,878
DATED : September 19, 2000
INVENTOR(S) : Follensbee et al.

It is certified that error appears in the above-identified patent and that said Letters Patent is hereby corrected as shown below:

Column 3,
Line 46, "saturated" should read -- saturate --.

Column 5,
Line 3, "Internaltional");" should read -- International); --.

Column 6,
Line 29, "divinyl ether" should read -- divinylether --.

Column 11,
Line 52, "<1" in col. 2 of Table 6 should read -- <2 --.

Signed and Sealed this

Sixteenth Day of April, 2002

*Attest:*

*Attesting Officer*

JAMES E. ROGAN
*Director of the United States Patent and Trademark Office*